United States Patent [19]

Ishii et al.

[11] 4,437,416

[45] Mar. 20, 1984

[54] APPARATUS FOR PYROLYZING

[75] Inventors: Yoshiaki Ishii; Tsutomu Kume; Naoyoshi Ando; Shosaku Fujinami, all of Kanagawa, Japan

[73] Assignee: Agency of Industrial Science and Technology, Tokyo, Japan

[21] Appl. No.: 382,350

[22] Filed: May 26, 1982

Related U.S. Application Data

[62] Division of Ser. No. 199,543, Oct. 22, 1980, Pat. No. 4,344,373.

[30] Foreign Application Priority Data

Oct. 30, 1979 [JP] Japan ..... 54-139271
Oct. 30, 1979 [JP] Japan ..... 54-139272

[51] Int. Cl.[3] ..... F23D 1/00; F23G 5/00

[52] U.S. Cl. ..... 110/245; 110/347; 110/229

[58] Field of Search ..... 110/245, 347, 229; 48/209

[56] References Cited

U.S. PATENT DOCUMENTS

Re. 26,514 12/1968 Albertson et al. ..... 110/245
3,366,080 1/1968 Albertson ..... 110/245
3,853,498 12/1974 Bailie .
4,057,402 11/1977 Patel et al. ..... 110/347
4,206,186 6/1980 Holter et al. ..... 110/245

FOREIGN PATENT DOCUMENTS 1498034 10/1967 France ..... 110/245

OTHER PUBLICATIONS

Disposal of Municipal Refuse by the "Two-Bed Pyrolysis System" by N. Andoh, Y. Ishii, Y. Hirayama and K. Ito, Reagling Berlin, 1979, vol. I.

*Primary Examiner*—Henry C. Yuen
*Attorney, Agent, or Firm*—Wenderoth, Lind & Ponack

[57] ABSTRACT

An apparatus for safely and continuously pyrolyzing organic material, such as contained in municipal waste, in a two-bed pyrolysis system including a pyrolysis reactor and combustion reactor in which several different physical factors influencing the state of fluidization, such as amount of sand in the system, circulation rate of the sand, pressure difference between the free boards of the two reactors and superficial velocity in the pyrolysis reactor, are comprehensively controlled or regulated so as to maintain the operating point of the system at substantially the center of the stable operating range. The feed rate of material charged into the system may also be regulated as required.

7 Claims, 14 Drawing Figures

APPARATUS FOR PYROLYZING

This a divisional of Ser. No. 199,543, filed Oct. 22, 1980, now U.S. Pat. No. 4,344,373.

FIELD OF THE INVENTION

The present invention relates to a two-bed pyrolysis system and more particularly to an apparatus for pyrolyzing municipal waste or the like while maintaining substantially a stable condition in a two-bed pyrolysis system.

BACKGROUND OF THE INVENTION

The problem of how to dispose of municipal waste is becoming serious in many cities since the amount of municipal waste is rapidly increasing in every city.

Some of the constituents of the waste are recovered by the method and apparatus disclosed in U.S. Pat. Nos. 3,973,735 and 4,076,177. However, some part of the waste is usually incinerated for disposal which may result in loss of usable resources.

If organic materials are thermally decomposed, pyrolysis gas may be recovered therefrom. To such end, a two-bed type of pyrolysis apparatus such as is employed in the petrochemical, coal-chemical or the like processes has been utilized. However, the two-bed thermal reactor of the prior art was originally designed for relatively uniform materials such as petroleum or coal rather than a mixture of types of material. Thus, special consideration should be given to treating municipal waste, which contains a mixture of several kinds of materials including solids and non-organic materials, in the two-bed pyrolysis apparatus.

A two-bed pyrolysis apparatus generally comprises a pyrolysis fluidized bed reactor where endothermic decomposition is performed to produce pyrolysis gas and a regenerator or combustion fluidized reactor where primarily an exothermic reaction is performed with respect to char, oil and tar produced in the pyrolysis reactor and introduced therein. In the combustion reactor, pyrolysis gas generated in the pyrolysis reactor may be introduced for aiding regeneration of sand in case the amount of char, oil and tar to be burnt therein is insufficient and, therefore, variation in the amount of exhaust gas from the regenerator is made relatively small. However, in the pyrolysis reactor, the amount of pyrolysis gas generated as well as the free board pressure of the pyrolysis reactor vary due to the fact that the type and size of the constituents of waste to be decomposed and their water content vary widely whereby, as a consequence, stable circulation of fluidized medium or sand may be obstructed.

On the other hand, the composition and the amount of generated pyrolysis gas are greatly influenced and are subjected to variation by the pyrolyzing temperature. It is difficult to keep the pyrolyzing temperature constant if the composition, water content, etc. of the material to be pyrolyzed vary.

Therefore, it has been generally experienced that the composition and the amount of pyrolysis gas generated in the conventional two-bed pyrolysis apparatus are not maintained constant. Variation in the composition of the generated gas naturally leads to inconvenience in its use since regulation of the nozzle size of the burner or adjustment of other elements is required to cope with such variation.

Also, continuous operation of the two-bed pyrolyzing apparatus is sometimes disturbed due to blocking or blowing through in a passage for circulating fluidized medium or sand between two reactors. Such blocking or possibility of blowing through is enhanced when the municipal waste is processed in the two bed pyrolysis apparatus since the waste usually contains several articles of foreign material such as solids and non-organic materials which may not be incinerated and may become clinkers.

SUMMARY OF THE INVENTION

Accordingly, it is an object of the present invention to provide an apparatus for pyrolyzing municipal waste free of the drawbacks referred to above.

It is a further object of the present invention to provide an apparatus for substantially automatically regulating the pyrolyzing process in a two-bed pyrolyzing system so as to maintain continuous and stable operation of the system.

Still another object of the present invention is to generate pyrolysis gas having a high calorific value and stable composition in the two bed pyrolysis system.

Another object of the present invention is to provide an apparatus for operation of the two-bed pyrolysis system in which smooth and continuous circulation of the fluidized medium is possible. According to the present invention, an apparatus is provided which achieves the above objects by using a two-bed pyrolysis system comprising primarily a pyrolysis reactor and a combustion reactor.

In the apparatus of the present invention, several different physical factors concerning fluidizing conditions, such as amount of sand in the system, circulation rate of the sand, pressure difference between the free boards of two reactors and superficial velocity in the pyrolysis reactor, are simultaneously and comprehensively controlled or regulated to maintain the operation of the system at substantially the center of a predetermined stable range or zone. Also, in order to maintain a constant pyrolysis temperature, the feed rate of material to be pyrolyzed may also be regulated, if necessary.

Further, blocking of the passage through which sand circulates or blowing of unwanted gas into and through the pyrolysis reactor is positively prevented according to the present invention thereby making it possible to continue stable operation without the need for temporary shutdowns of the system.

These advantages and other objects of the present invention will be further clarified from the following description of the preferred embodiment according to the present invention, which follows the brief explanation of drawings summarized below.

Figure 1:
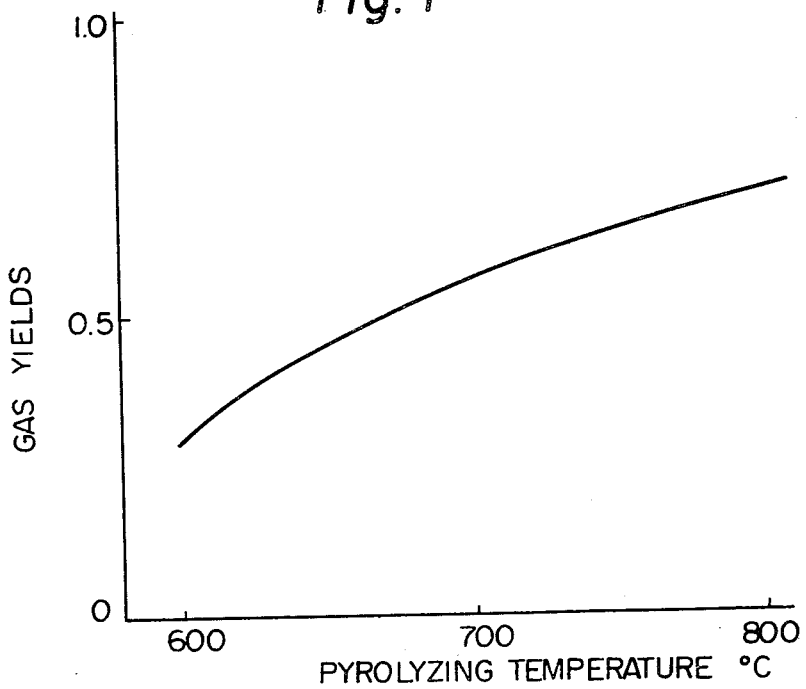
FIG. 1 is a graph showing the relationship between pyrolyzing temperature and amount of gas produced by pyrolyzing.
Figure 2:
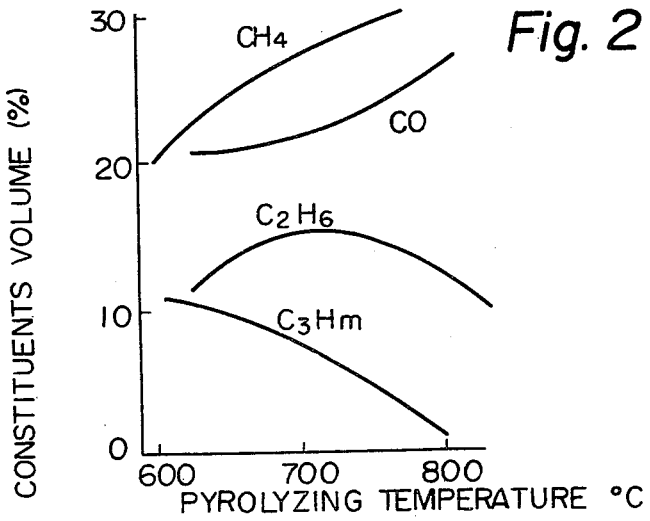
FIG. 2 is a graph showing the relationship between the pyrolyzing temperature and the composition of the pyrolysis gas.

DETAILED DESCRIPTION OF THE PREFERRED EMBODIMENTS:

Before explaining the preferred embodiment of the present invention, the effect of variation in the pyrolyzing temperature is presented to facilitate understanding the background of the present invention. FIG. 1 indicates an example of gas yields relative to the pyrolyzing temperature wherein the increase in yields is illustrated as somewhat proportional to the increase of the temperature, and FIG. 2 indicates an example of gas composition relative to the pyrolyzing temperature in which remarkable variation in the composition is observed when the temperature is varied and this variation causes inconvenience in utilization thereof since the calorific value of the gas varies depending on the composition.

Figure 3:
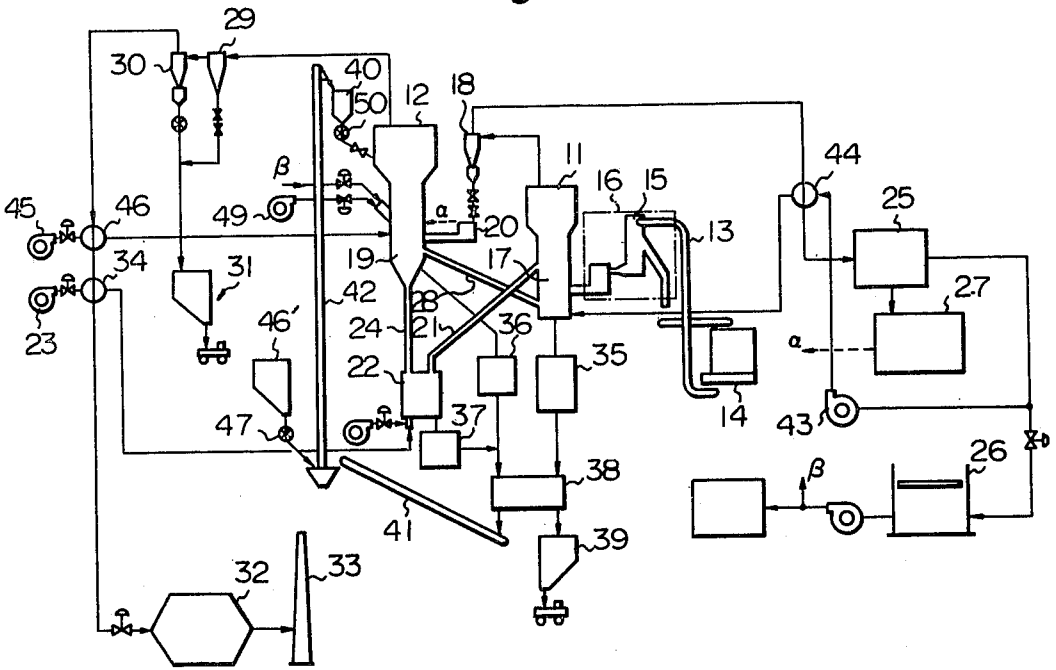
FIG. 3 is a schematic illustration of a two-bed pyrolysis system utilized in the present invention.

Referring now to FIG. 3, there is schematically shown a two-bed pyrolyzing system according to the present invention. The primary portion of the system comprises a fluidized bed pyrolysis reactor 11 wherein endothermic decomposition is performed and a fluidized bed combustion reactor or regenerator 12 wherein exothermic reaction or combustion of char, oil, tar, etc. produced in the reactor 11 is primarily performed. A fluidized medium such as sand is circulated between the two reactors 11 and 12 through passages as is explained hereinafter.

Municipal waste or the like which is to be pyrolyzed to produce pyrolysis gas is conveyed by a conveyor 13 from a storage 14 to a supply hopper 15. Thence, the waste or material to be pyrolyzed is charged by a feeder 16 into a pyrolysis fluidized bed 17 within the reactor 11, while the feeder 16 functions to effect regulation of the amount of waste fed as well as gas sealing at a charge port in the reactor 11. The charged waste is pyrolyzed in the fluidized bed 17 and generates pyrolysis gas which is taken out from the free board of the reactor 11 to a cyclone 18 where char accompanying the generated gas is collected and such char is charged into a combustion fluidized bed 19 in the regenerator 12 through a char feeder 20.

The temperature of the sand or other fluidized medium decreases due to endothermic reaction in the pyrolysis fluidized bed 17 and the sand and accompanying char generated during the reaction is fed downwardly through an inclined conduit 21 to an ejecting reservoir 22 into which air is blown from a blower 23 and the sand is lifted by the air through a lifting conduit 24 into the combustion fluidized bed 19. The regenerator 12 and the ejecting reservoir 22 may be regarded as constituting upper and lower portions, respectively, of a total combustion reactor. The combustible char is burnt in the ejecting reservoir 22 and then further burnt completely in the fluidized bed 19 thereby raising the temperature of the fluidized medium or sand. The char supplied from the feeder 20 is also burnt in the fluidized bed 19.

The pyrolysis gas generated in the pyrolysis reactor 11 and passed through the cyclone 18 is conveyed to a gas cleaner 25 and thence to a gas holder or reservoir 26. The gas received in the reservoir 26 is utilized as a clean fuel recovered from the waste and having high calorific value. At the gas cleaner 25, the liquid contained in the generated gas is removed and forwarded to a liquid processor 27 where oil and tar contained in the liquid are removed and fed back as indicated by arrows "$\alpha$" into the combustion reactor 12 where they are also burnt and the water removed from the liquid thus processed may be discharged outside of the system, such discharge being controlled so as to avoid environmental pollution.

The sand regenerated or raised in temperature is conveyed from the combustion bed 19 through a downwardly inclined conduit or passage 28 to the pyrolysis bed 17 so as to maintain the pyrolyzing temperature therein, e.g. approximately 700° C. to 800° C., by the circulation of the sand.

The exhaust gas from the free board of the combustion reactor 12 is fed to pass an aluminum eliminator 29 and a dust cyclone 30 where light metallic constituents such as aluminum waste and ash or dust are collected, respectively, from the exhaust gas and they are discharged to a disposing means 31 such as a bin and a truck as illustrated for further disposition. The exhaust gas is further fed to a dust collector 32 such as an electronic dust collector where dust still remaining in the exhaust gas is removed and the exhaust gas thus cleaned is finally discharged into the atmosphere through a gas stack 33. The passage of the exhaust gas is preferably arranged to pass through a heat exchanger to transfer its thermal energy to the medium introduced into the system. In the illustrated arrangement, the passage is arranged to pass a heat exchanger 34 wherein the thermal energy is transferred to air blown from the blower 23 to the ejecting reservoir 22. Several other heat exchangers are employed in the system so as to recover thermal energy as will be explained hereinafter.

Non-combustible constituents in the material charged into the system are discharged from the bottom portions of the pyrolysis reactor 11, regenerator 12 and ejecting reservoir 22 where an appropriate valve means (not shown) is disposed, respectively through discharge means 35, 36 and 37 to a sand separator 38. The sand separator separates the sand from foreign materials and directs the foreign materials to a disposing means 39 similar to the disposing means 31 and returns the sand to a sand hopper 40 through conveyors 41 and 42.

Fluidization of the beds 17 and 19 is effected by blowing a part of the generated and cleaned pyrolysis gas upwardly from a lower distribution means in the reactor 11 and air upwardly from a lower distribution means in the regenerator 12, respectively, in a manner known in the art.

The pyrolysis gas for fluidization is pressurized by a blower 43 and directed to the pyrolysis reactor 11 through a heat exchanger 44 where the thermal energy of the pyrolysis gas taken out from the free board of the pyrolysis reactor 11 is transferred to the gas directed to the reactor 11 for fluidization. The air for fluidizing the bed 19 is pressurized by a blower 45 and forwarded to the regenerator 12 through a heat exchanger 46 where the thermal energy of the exhaust gas is transferred to the air directed to the regenerator 12 for fluidization.

Sand for replenishment of sand in the system is supplied from a sand bunker 46' to the sand hopper 40 preferably at a constant rate by means of a feeder 47 and the conveyor 42. From the sand hopper 40, the sand is supplied to the regenerator 12 through a sand feeder 50 in response to information on the amount of sand in the system which will be further explained later.

The amount of char produced in the pyrolysis reactor 11 may vary depending on the composition of the waste charged thereinto. If the amount of char is insufficient to maintain the temperature for regenerating the sand or raising the temperature thereof, the pyrolysis gas from the holder 26 may be utilized to aid the regeneration by being supplied to the regenerator 12 in the direction of arrows "$\beta$" together with necessary air supplied from a blower 49. As touched upon earlier, one of the factors in maintaining the desired stable operation of the two-bed pyrolysis system is that the flow of the sand or other fluidized medium in the system must be smoothly effected while maintaining gas sealing in the inclined conduits or passages 21 and 28 by having the sand continuously circulating through the system including the passages 21 and 28. Should mixing the gases between the two reactors 11 and 12 occur through the conduits 21 and 28 coupling the reactors, the mixing of the gas and/or air from the regenerator 12 into the pyrolysis gas in the pyrolysis reactor 11 lowers the calorific value of the generated pyrolysis gas. Accordingly, from the viewpoint of producing pyrolysis gas of high quality, i.e. gas having high calorific value and stable composition, it is desirable to securely effect gas sealing between the two reactors 11 and 12. In order to maintain reliable gas sealing, it is necessary to sufficiently fill the conduits 21 and 28 with the sand as well as to control the levels of the two fluidized beds 17 and 19 in the reactors 11 and 12 within a certain range.

The level of either of the fluidized beds in a two-bed pyrolysis system is a function dependent on the amount of sand in the system, the rate of sand circulation, superficial velocity in the pyrolysis reactor and the pressure difference between the two reactors.

In the system according to the present invention, the rate of sand circulation is in a substantially linear relationship with the feed rate of lifting air in the regenerator and independent from the fluidizing gas circulated in the pyrolysis reactor.

Accordingly, if the rate of sand circulation is set based on the feed rate of the material to be pyrolyzed, water content of the same and energy balance dependent on the respective temperature conditions of the two reactors, the feed rate of lifting air is also naturally set and the circulation rate of the fluidizing gas in the pyrolysis reactor, i.e. the superficial velocity in the pyrolysis reactor, is determined independently of the feed rate of the lifting air so as to maintain fluidization in good order. When the circulation rate of the sand and the superficial velocity in the pyrolysis reactor are set as above, continuous and stable operation of the system is easily achieved by regulating the pressure difference between the two reactors while monitoring the respective levels of the fluidized beds.

Figure 4:
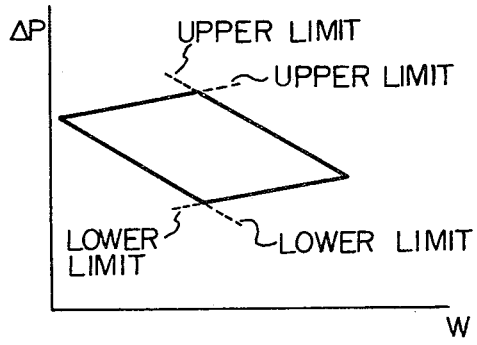
FIG. 4 is a graph showing a stable zone of the system operation with respect to pressure difference between two reactors and the amount of sand in the system.

In FIG. 4, there is shown an operating range for regulating the pressure difference $\Delta P_T$ between the two reactors and the amount of sand in the system. The range is shown as a lozenge which is determined after setting the respective upper and lower limits of the two fluidized bed levels by taking the structural factors such as the positions of the conduits 21 and 28 into consideration. The position of the lozenge in FIG. 4 will be displaced upwardly as the circulation rate of the sand decreases and vice-versa. The preferred set of operating conditions is naturally the center of the lozenge.

Heretofore, in order to maintain stable operation of a two bed pyrolysis system, operating factors such as the amount of sand in the system, the circulation rate of the sand, the superficial velocity in the pyrolysis reactor and the pressure difference between the reactors have been independently regulated at the discretion of the operator. However, according to the present invention, several different physical values such as the amount of the sand in the system, the circulation rate of the sand, the superficial velocity in the pyrolysis reactor and the pressure difference between the reactors are sensed or measured and optimum operation of the system is effected by comprehensively considering all these physical values as parameters and regulating them accordingly. Before discussing the control of the system based on comprehensive consideration of all factors, each individual parameter will be explained hereunder.

Regulation or control of the amount of the sand in the system is determined on the basis of the respective levels of the fluidized pyrolysis bed and combustion bed. These levels are conventionally determined by measuring the pressure difference between the upper portion and the lower portion of each of the fluidized beds. On the basis of the above determination the amount of said in the system is appropriately adjusted by actuation of the discharging means 35, 36 and 37 and/or the sand feeder 50 disposed between the sand hopper 40 and the combustion reactor 12 (FIG. 3).

Figure 5:
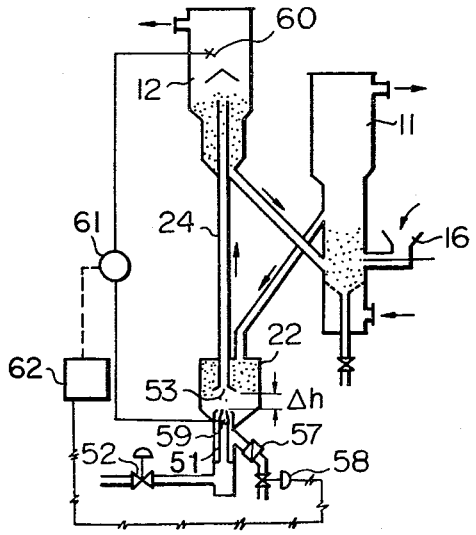
FIG. 5 is a schematic illustration of two reactors with means for controlling the circulation rate of the sand.
Figure 6:
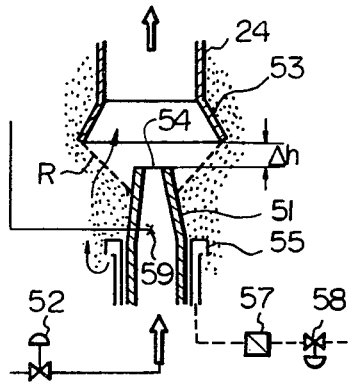
FIG. 6 is an enlarged partial schematic view showing the relationship between a nozzle and related elements illustrated in FIG. 5.
Figure 7:
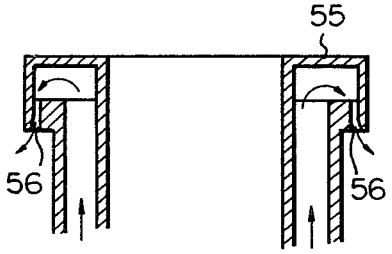
FIG. 7 is an enlarged sectional view of a ring disposed around the nozzle shown in FIG. 6.
Figure 8:
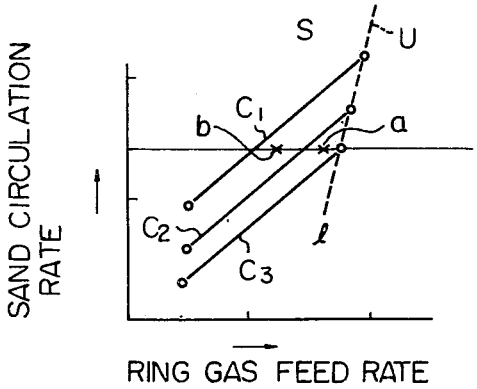
FIG. 8 is a diagram explaining the relationship between the circulation rate of the sand and feed rate of air supplied through the ring shown in FIG. 7.

The control of sand circulation rate will now be discussed. In FIGS. 5, 6 and 7, the construction of the lifting device and the lower part thereof are schematically illustrated. At the bottom of the ejecting reservoir 22, a lifting nozzle 51 is disposed for injecting a gas upwardly to lift the sand from the reservoir 22 to the free board of the regenerator 12 through the lifting conduit 24. The feed rate of the gas may be controlled by a device such as a valve 52. The gas injected upwardly from the nozzle 51 may be air or a mixture of air and vapor. The lower end of the lifting conduit 24 is funnel shaped as illustrated in FIG. 6, and it is positioned above the upper end opening of the nozzle 51 and separated therefrom by a space of dimension $\Delta h$ so that the end opening 54 is located above a surface corresponding to a free surface of the sand defined by the line "R" extending from the edge of the funnel shaped end 53 and representing an angle of rest or repose for the sand, thereby the nozzle end opening 54 extends upwardly from the free surface "R" of the sand even when the system is not operated. In order to facilitate lifting the sand as well as regulating the rate of sand circulation, a fluidizing ring 55 is mounted around the nozzle 51 and below the opening 54, and air which is fed through a flow-meter 57 and a flow regulating valve 58 is blown in a downward or diagonally downward direction from an annular gap 56. The air injected or blown out of the ring 55 causes disturbance in the fluidizing medium or sand adjacent the nozzle 51 thereby decreasing the angle of repose of the same and thereby it becomes easy to make the sand flow toward the upper zone of the nozzle 51 where the sand is sucked into the funnel end 53 due to ejection of the lifting gas from the nozzle opening 54. The feed rate of the air to the fluidizing ring 55 has an important effect on the circulation rate of the sand since any variation in the feed rate of the air to the ring 55 causes a change in the fluidization around the nozzle 51 thereby causing variation in the amount of sand blown into the lifting conduit 24 through its funnel end 53. The relationship of the feed rate of the air to the ring 55 and the circulation rate of the sand is shown in FIG. 8. The dotted line "*l*" is a border between the stable zone (S) and the unstable zone (U). In FIG. 8, three curves $C_1$, $C_2$ and $C_3$ are illustrated each of which represents the relationship under a certain feed rate of lifting air, respectively wherein $C_1 > C_2 > C_3$. In this figure, the points "a" and "b" represent the same circulation rate of the sand but the operating point "a" is preferable because the feed rate of the lifting air at "a" is less than that at "b" although the point "a" is closer to the unstable region "U" than as the point "b".

According to the graph shown in FIG. 8, it is noted that the circulation rate increases as the ring air is increased provided that it is within a certain range. Accordingly, by utilizing the relationship shown in FIG. 8, it is possible not only to stabilize the lifting rate of the sand but also to regulate the same. In general, the pressure loss in the conveying duct for a powdery material varies depending on the mixing ratio of the mixture of the conveying gas and the material to be delivered thereby. For example, in FIG. 5, in the inside of the lifting duct 24, the concentration of the sand in the upwardly moving mixture is relatively thin and, thus, it is possible to measure the circulation rate of the mixture by sensing the pressure difference between two points in the lifting conduit 24. However, the mixture may cause plugging or clogging of the pressure sensing ports and, thus, the sensing in lifting conduit may not be appropriate. Therefore, it is rather preferred to provide one sensing port 59 in the nozzle 51 and the other sensing port 60 at the top portion of the free board in the regenerator 12 where the possibility of plugging by the sand may be neglegible. By detecting the pressure difference $\Delta P$ between the sensing ports 59 and 60, the circulation rate of the sand may be measured. Since with this arrangement there is little chance of plugging the ports by sand, it is possible to detect the pressure difference under stable conditions. The pressure difference $\Delta P$ is measured by a detector 61 which delivers a signal corresponding to $\Delta P$ to a controller 62 and this controller 62 regulates the valve 58 so as to regulate the ring air, thereby controlling the circulation rate of the sand as explained with respect to FIG. 8.

As illustrated in FIG. 8, there is a limit to the increase of the circulation rate of the sand only by the regulation of the ring air. For instance, if the ring air is regulated so as to make the circulation rate of the sand to be beyond its upper limit, air or a mixture of air and vapor may blow upwardly into the pyrolysis reactor 11 through the conduit 21. Therefore, if it is desired to increase the circulation rate of the sand under critical conditions, the feed rate of the lifting air is to be increased—for example, from the $C_1$ side to the $C_3$ side in FIG. 8 by regulating the valve 52.

Figure 9:
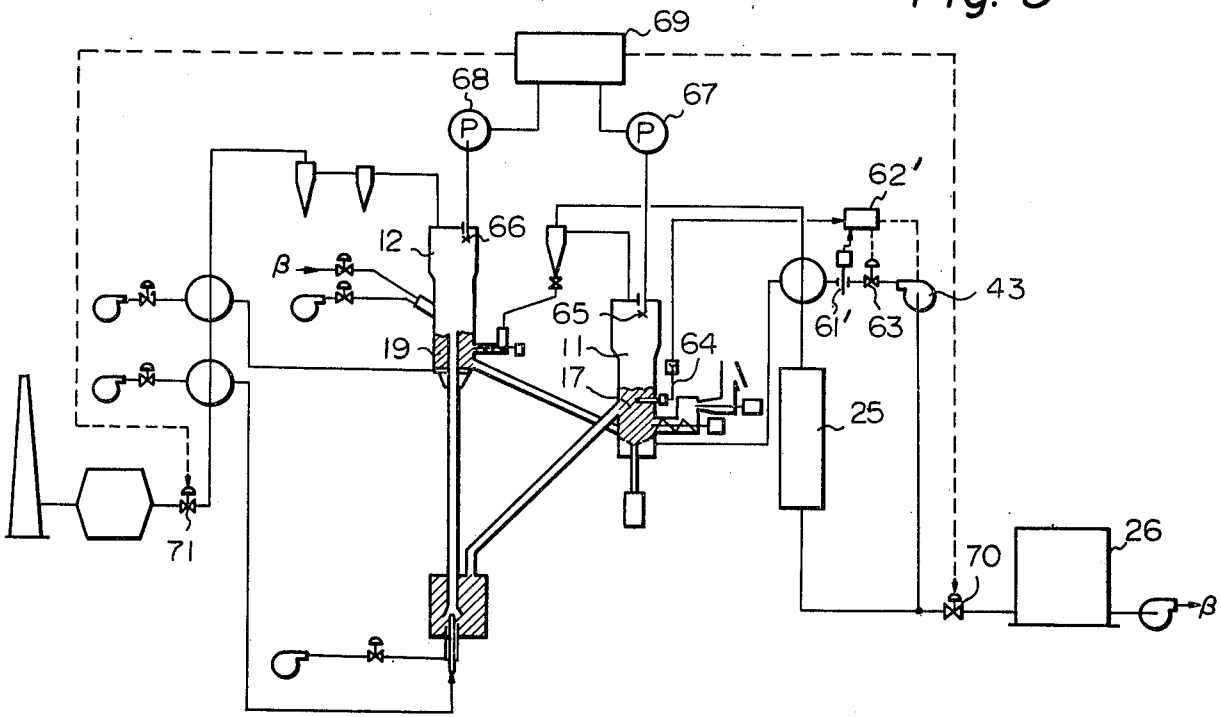
FIG. 9 is a schematic illustration of a system for regulating the operation based on the pressure difference between the free boards of the two reactors.

Next, regulation of the superficial velocity in the pyrolysis reactor will be explained referring to FIG. 9. The superficial velocity is naturally determined to maintain a desired fluidized state by regulating the blower or valve. As explained regarding FIG. 3, a part of the pyrolysis gas generated is utilized as a fluidizing gas for the pyrolysis reactor 11 by means of the blower 43. The flow rate of the gas is measured by a flow meter 61' and, depending on the information from the flow meter, a controller 62' regulates a regulator valve 63 or the blower 43 so as to maintain the desired flow rate. Also, a temperature detector 64 is arranged to sense the temperature of the fluidized bed 17 and forward its information to the controller 62' which incorporates the sensed temperature value for determining and controlling the feed rate of the fluidizing gas.

The control of the pressure difference between the two reactors 11 and 12 will now be explained referring also to FIG. 9. In this disclosure, the term "pressure difference between the two reactors" means the difference in pressure between the free boards of the two reactors. For measuring this pressure difference, pressures at points 65 and 66 in the free boards of the pyrolysis reactor 11 and combustion reactor 12, respectively, are sensed by pressure gauges 67 and 68 which deliver the information regarding respective pressure values to a pressure controller 69 for determining the pressure difference $\Delta P_T$. In response to the determined value $\Delta P_T$, the controller 69 regulates either or both of valves 70 and 71 disposed in output lines of the pyrolysis gas and exhaust gas, respectively, so as to maintain the desired pressure difference. A control system for maintaining the pressure difference has been explained above in a simplified form, but it is to be understood that other systems may also be utilized.

In the foregoing explanation, the control or regulation of the several physical values independently have been discussed. However, as touched upon earlier, it is preferred to control these physical values as one set or comprehensively based on data and experiments so that the whole system is safely and stably operated under ideal conditions on the basis of information or signals fed back to the respective controllers. By introducing such comprehensive control of the total system, the number of operators may be kept to a minimum.

Figure 10A:
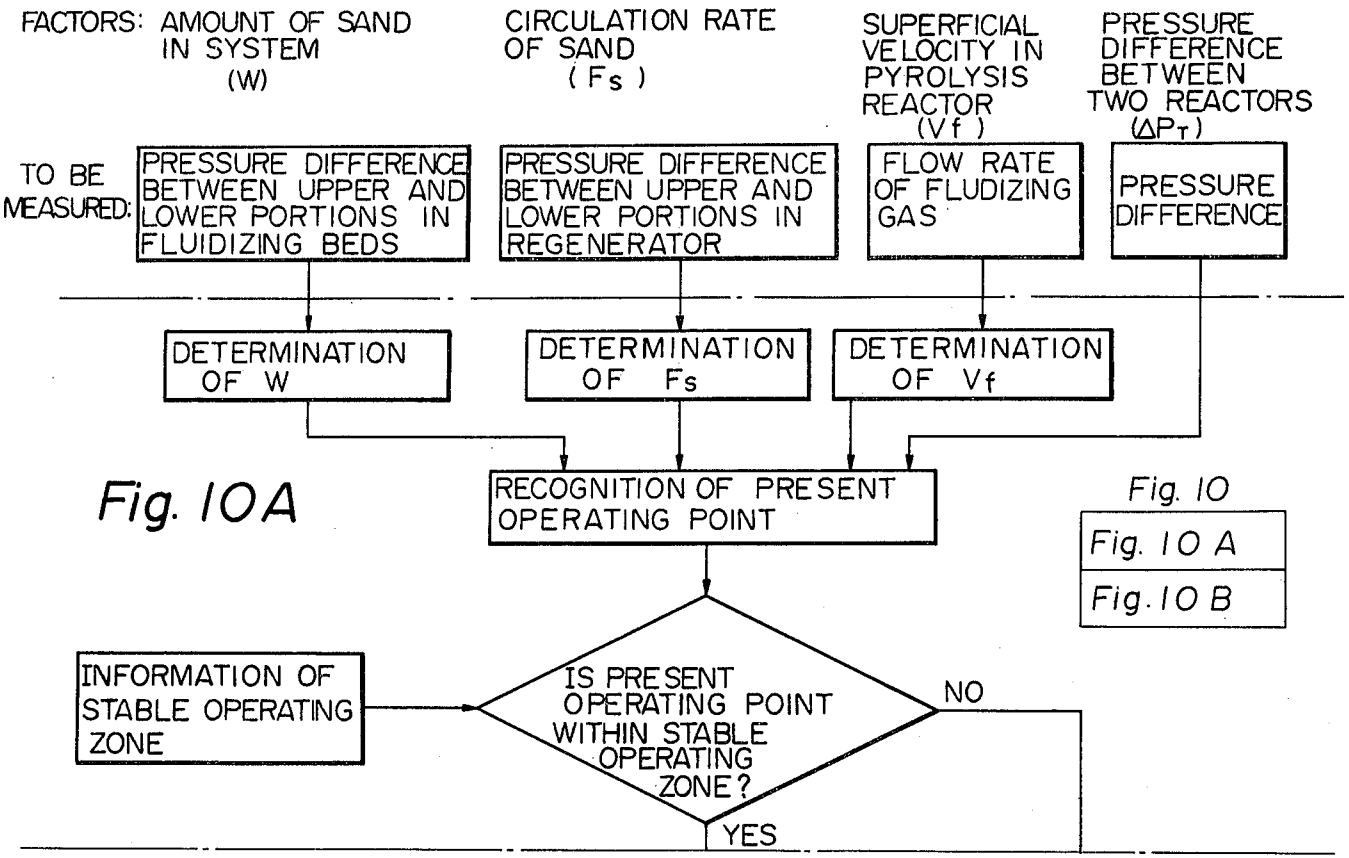
FIG. 10 (FIG. 10A and FIG. 10B) is a flow chart showing how the several different physical factors involved in the system are controlled or regulated.
Figure 10B:
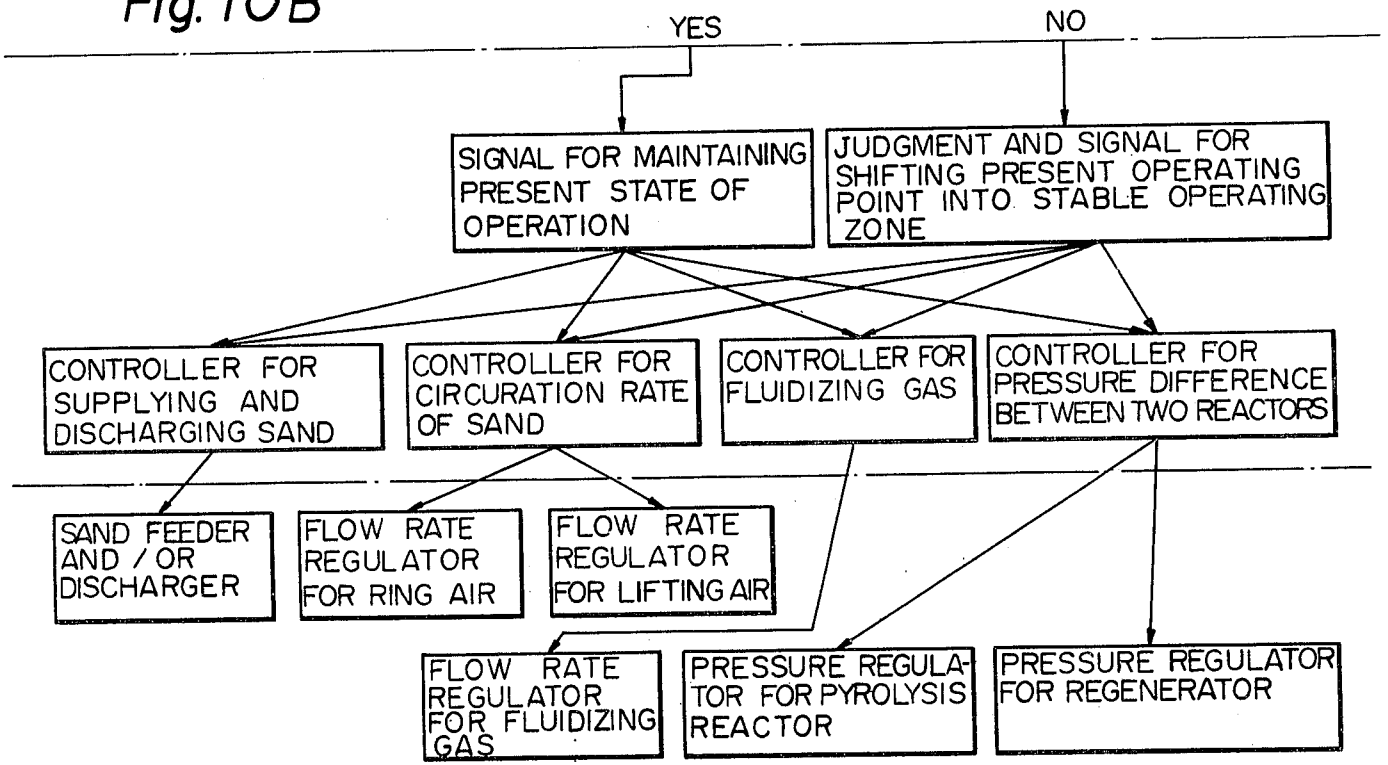

FIG. 10 is a flow chart of such a comprehensive control system. For convenience of illustration, FIG. 10 is divided into FIGS. 10A and 10B which are to be reviewed in combination. As already explained, the amount of sand in the system is determined by the pressure difference between the upper portion and the lower portion in each of the fluidized beds, the circulation rate of the sand is determined by the pressure difference between the upper and lower parts in the regenerator, and the superficial velocity in the pyrolysis reactor is obtained from the flow meter for the pyrolysis reactor fluidizing gas. Taking these values together with the pressure difference $\Delta P_t$ between the two reactors, the preferable operating point, ideal operating point and the safety operating zone around that point are determined. Optimum operation is, thus, carried out by firstly judging whether the operation is within the safety zone and then, based on this judgement, respective signals are supplied to each of the controllers as to whether the operating condition of the respective portion is to be maintained or changed to achieve and maintain the continuous and stable operation of the system. The optimum operating point would be selected as the center of the safety operation zone referred to above.

Depending on the situation, the superficial velocity in the pyrolysis reactor may be eliminated from the factors for controlling the system. The limits of the safety operation zone are determined taking the following into consideration.

One important matter to be kept in mind in the operation of the two bed pyrolysis system is to prevent the condition of blowing through or generation of bubbles from occurring in the coupling conduit 21 (FIG. 3) which may result in air being mixed with the pyrolysis gas produced in the pyrolysis reactor 11 thereby lowering the calorific value of the pyrolysis gas. Blowing through in the coupling conduit especially disturbs the operation and, when it occurs, continuous and stable operation of the system can not be expected. Therefore, in order to insure continuous and stable pyrolyzing operation in the two bed pyrolysis system as well as to obtain a pyrolysis gas having a stable composition and high calorific value, it is necessary to securely seal the coupling conduits 21 and 28, especially the former. In the embodiment illustrated and explained, the gas sealing of both conduits 21 and 28 is effected by using a thermal fluidizing medium, i.e. the sand. Therefore, there must be enough sand in the coupling conduits while the sand is continuously circulating between the two reactors. Such satisfactory material sealing may be accomplished if each of the fluidized bed levels is maintained within a certain range.

From theoretical analysis and pilot plant experiments regarding the pressure balance, etc. in the system, it is known that the levels of the fluidized beds may be expressed by the following formulae:

$$H_{RA}=f_1(W.F_s, V_f, \Delta P_t),$$

$$H_{RG}=f_2(W, F_s, V_f, \Delta P_t)$$

wherein:

$H_{RA}$: pyrolysis fluidized bed level (measured from the distribution plate), $H_{RG}$: combustion fluidized bed level (measured from the distribution plate), W: amount of sand in the system, $F_s$: circulation rate of sand $V_f$: superficial velocity in pyrolysis reactor, $\Delta P_t$: pressure difference between the two reactors.

That is, the levels $H_{RA}$ and $H_{RG}$ are functions of W, $F_s$, $V_f$, and $\Delta P_t$. The respective limits of the levels of $H_{RA}$ and $H_{RG}$ are defined as follows.

$H_{RA}$ min.: The lower limit of the sand level in the pyrolysis reactor. This is the lowest level which may at least satisfactorily fill the conduit 21. This level substantially corresponds to the intake opening of the coupling conduit 21; however, the practical lower limit is to be determined by taking into consideration such factors as the necessary minimum depth of the fluidizing bed.

$H_{RA}$ max.: The upper limit in the pyrolysis reactor which may be determined based on the maximum capacity of the blower.

$H_{RG}$ min.: The lowest level of the combustion fluidized bed which may at least satisfactorily fill the conduit 28. This level substantially corresponds to the position of the intake opening of the coupling conduit 28; however, the practical lower limit is to be determined by taking into consideration other factors such as the necessary depth of the fluidizing bed.

$H_{RG}$ max.: Either the lowest among the upper limit of the combustion fluidized bed wherein the auxiliary burning is able to be satisfactorily performed or the upper limit available by the delivery pressure or the capacity of the blower.

In the operation of the present system, the respective values of W, $F_s$, $V_f$ and $\Delta P_t$ are selected as exemplified below for determining the levels $H_{RA}$ and $H_{RG}$. The specific values noted below are merely examples and are not limiting of the present invention.

"W" is to be determined referring to the size and structure of the reactors. However, in general, it may be the amount of sand which gives the following levels during normal operation.

$$H_{RA}>300 \text{ mm}$$

$$H_{RG}<3000 \text{ mm}.$$

Of course, it is preferable to maintain the levels $H_{RA}$ and $H_{RG}$ substantially constant during the operation of the system. In case either or both of the levels as set above is/are caused to deviate from the desired setting levels, the condition of which may also be determined by the pressure difference $\Delta P_t$ between the two reactors, reinstatement of the levels to the desired levels may be achieved by actuation of the valve 70 (FIG. 9) and/or changing the circulation rate of the sand. The circulation rate is primarily altered by regulating the ring air as explained referring to FIG. 8, since the operation mode in the regenerator is relatively stable compared to that in the pyrolysis reactor where the char and tar are spattering.

The value of $F_s$ is determined by the energy balance taking into consideration the feed rate and water content of material to be pyrolyzed and the temperature conditions in the two reactors. The difference in temperature between the two reactors is usually set within the range of 20° C. to 300° C. In the present system, $F_s$ is related to the feed rate of the lifting air in the combustion reactor in a substantially linear relationship and may be determined independently of the feed rate of the fluidizing gas for the pyrolysis reactor.

As to $V_f$, it is independent from the feed rate of the lifting air. The lower limit of $V_f$ is determined so as to be the minimum value which may be able to fluidize the pyrolysis fluidized bed and the upper limit thereof is one which may not cause remarkable abrasion of the fluidizing medium of the sand and excessive scattering of the same. The value thereof may be in the following range:

$$0.4 \text{ m/s}<V_f<3.0 \text{ m/s}.$$

Usually, where there is no generation of pyrolysis gas, $V_f$ is set to be 0.4 m/s to 1.2 m/s and, when the pyrolysis gas is generated, it is increased thereby. Under such generation of the pyrolysis gas, the operating point is usually selected so that $V_f$ becomes 0.8 m/s to 2.5 m/s.

Regulation of $\Delta P_t$ is performed in the following manner. When $V_f$ is increased due to the generation of the pyrolysis gas, the $H_{RA}$ and $H_{RG}$ levels are also caused to vary. Thus, the pressure difference $\Delta P_t$ is regulated so that the $H_{RA}$ and $H_{RG}$ levels are maintained within the respective stable zones, that is, the following relationship is satisfied.

$$H_{RA}\,\text{min.} < H_{RA} = f_1(W, F_s, V_f, \Delta P_t) < H_{RA}\,\text{max.}$$

$$H_{RG}\,\text{min.} < H_{RG} = f_2(W, F_s, V_f, \Delta P_t) < H_{RG}\,\text{max.}$$

Figure 11:
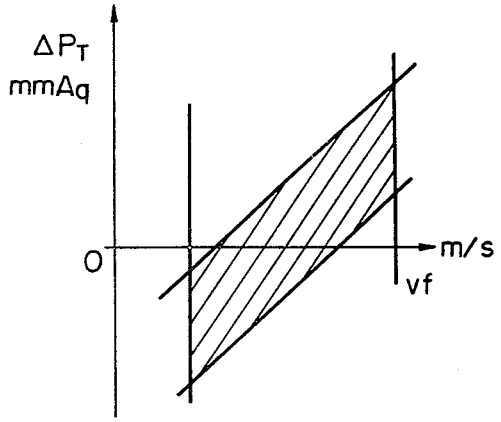
FIGS. 11 and 12 are graphs showing stable operating ranges or zones regarding the superficial velocity in the pyrolysis reactor and feed rate of the material, respectively, with respect to the pressure difference between the two reactors.

By determining the amount of W under operation and the value of $F_s$ based on the feed rate of material to be processed or pyrolyzed, the preferred operational zone will assume, according to the formulas above, a lozenge shape as illustrated in FIG. 11. Continuous and stable operation is obtained by regulating $\Delta P_t$ and/or $V_f$ so that the operating point is within the lozenge in FIG. 11. During normal operation, the actual value of $\Delta P_t$ is, for example, between −5000 mm Aq and 5000 mm Aq. Also, if $F_s$ is set depending on the feed rate of the material and $V_f$ is set for the period of generating pyrolysis gas, the operational range for $\Delta P_t$ and W is obtained as illustrated in FIG. 12 within which continuous and stable operation of the system is expected.

If the amount of material to be processed is increased, stable operation is obtained by altering $F_s$ so that the temperature difference between the two fluidizing beds 17 and 19 is maintained within the range of 20° C. to 300° C.

Figure 12:
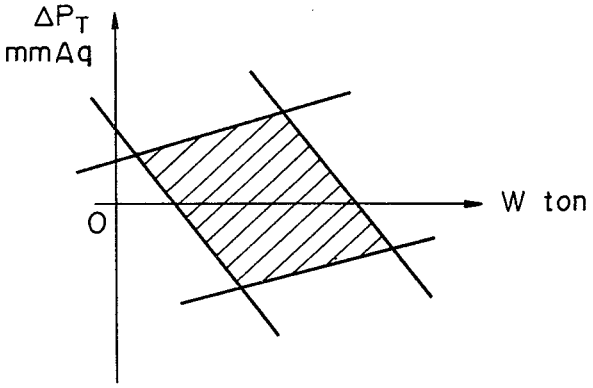

By setting the operating point so as to be at the center of the stable zone, if the operating point is displaced from the desired set point by any external factor(s), it is easy to reinstate the setting point by the concept illustrated in FIGS. 10, 11 and 12 and explained in the foregoing. As explained with respect to FIG. 2, it is also necessary to stabilize the composition of the pyrolysis gas generated. Heretofore, several parameters have been independently controlled at the discretion of the operator whereby energy balance may not be kept satisfactory due to variation of the composition, and the water content of the material to be processed or pyrolytically decomposed, and thus the composition of the pyrolysis gas may not be maintained substantially constant. In view of the fact shown in FIG. 2, it is necessary to keep the pyrolyzing temperature constant for stabilizing the composition of the generated pyrolysis gas.

If the composition, water content and feed rate of the material or waste to be pyrolyzed are determined, the thermal energy to be supplied to the pyrolysis reactor, the circulation rate of the sand, the respective temperatures of the fluidized beds in the respective reactors, and the amount of the pyrolysis gas to be supplied to the regenerator for aiding combustion therein are determined. In other words, calorific or thermal energy $Q_A$ to be supplied to the pyrolysis reactor may be expressed by the following equation:

$$Q_A = F_s \cdot C \cdot (T_{RG} - T_{RA}) \tag{1}$$

wherein:

$F_s$: circulation rate of sand

C: specific heat of sand $T_{RG}$: temperature in fluidized bed of regenerator; and $T_{RA}$: temperature in fluidized bed of pyrolysis reactor.

The amount of calories $Q_B$ taken away from the sand in the pyrolysis reactor is expressed as follows:

$$Q_B = [Q_1(1-\omega) + Q_2 + Q_3(1-\omega) + Q_4\phi] \cdot Z + Q_5 + Q_6 \tag{2}$$

wherein:

$Q_1$: amount to be pyrolyzed per unit weight of material, $Q_2$: calories consumed by water content per unit weight of material, $\omega$: ratio of water content in material before being charged into pyrolysis reactor, $Q_3$: calories to be supplied to pyrolize gas, oil and char produced in the pyrolysis reactor per unit weight of material (dry base), $Q_4$: calories to be supplied to non-combustible constituents of material per unit weight thereof, $\phi$: ratio of non-combustible constituents in material, $Q_5$: calories to be supplied to fluidizing gas (assuming the feed rate of the gas be constant), $Q_6$: heat loss from the wall of the pyrolysis reactor (substantially constant), and Z: feed rate of material.

In a case where the input and output of thermal energy are balanced, $T_{RA}$ will be expressed by the following:

$$T_{RA} = T_{RG} - \frac{[Q_1(1-\omega) + Q_2 + Q_3(1-\omega) + Q_4\phi]Z + Q_5 + Q_6}{F_s C} \tag{3}$$

If $Q_0$ is defined by the following formula, i.e.

$$Q_0 = Q_1(1-\omega) + Q_2 + Q_3(1-\omega) = Q_4\phi \tag{4}$$

then $T_{RA}$ is expressed as follows:

$$T_{RA} = T_{RG} - \frac{Q_0 Z + Q_5 + Q_6}{F_s C} \tag{5}$$

In order to keep the pyrolysis temperature (temperature in the fluidized bed of the pyrolysis reactor) constant regardless of variation in the material, i.e. variation in $Q_1$, $Q_2$, $\omega$, $\phi$ and Z, the following factors may be controlled.

(a) feed rate of material (Z);

(b) circulation rate of sand ($F_s$); and (c) feed rate of auxiliary fuel, (pyrolysis gas for aiding regeneration).

It is preferable to regulate the $T_{RA}$ by controlling the feed rate of the auxiliary gas but it is preferably controlled to maintain $T_{RG}$ below the temperature of producing clinker in the regenerator. If such regulation alone is not satisfactory, the circulation rate of the sand will next be adjusted by regulating the ring air. If it is still necessary to adjust the $T_{RG}$ even with the controls above, (i.e. controls of the items "b" and "c"), the feed rate of the material will be regulated. In this last instance, if $F_s$ and $T_{RG}$ are maintained constant, it is necessary to keep $$[Q_0 Z + Q_5 = Q_6]$$

constant as viewed from equation (5). If $T_{RA}$ is maintained constant, it may be enough to keep $Q_0Z$ substantially constant since $Q_5$ and $Q_6$ are generally kept constant. In other words, the feed rate of material is preferably regulated so as to cancel the variation of $Q_0$.

The apparatus of the present invention has been explained referring to the treatment of municipal waste in a two-bed pyrolyzing system but may be utilized for any other material to be pyrolyzed. Also, the continuous and stable operation has been discussed.

However, sometimes, particularly in treating municipal waste, non-combustible constituents such as metal, glass, earth sand and pebbles, etc. mixed therein must be separated and discharged out of the system as explained regarding the discharge means 31, 35, 36, 37, 38 and 39 etc. in FIG. 3 for maintaining continuous and stable operation. Otherwise these non-combustible constituents might fuse or stick together and become a large mass. These non-combustible constituents will be referred to as "foreign substance" for convenience.

The foreign substance is appropriately discharged out of the system periodically and/or automatically by the control of the system as schematically illustrated in FIG. 10. However, the non-combustible constituents or foreign substance may cause trouble during operation. For instance, if a foreign substance is conveyed from the reactor 11, without being discharged outwardly through the discharging means 35, to the ejecting reservoir 22 through the conduit 21, it might stay or dwell around the annular gap 56 of the ring 55 (FIGS. 6 and 7), and disturb the air flow through the gap 56 thereby abruptly increasing the circulation rate of the sand and making the operation unstable. As explained with respect to FIG. 8, it is difficult to prevent occurrence of such unstable condition especially if the operating point is set at "a" in FIG. 8 which is relatively close to the unstable zone, although the passage of the foreign substance from the pyrolysis reactor to the ejecting reservoir is rare since the intake opening of the conduit 21 is disposed at a relatively high position so as to maintain the minimum required depth of the fluidized bed 17. Should such unstable condition be encountered, the system has to be temporarily shut down in order to prevent occurrence of blocking in the lifting conduit and/or blowing through the conduit. Such unstable condition may be detected, for example, by the pressure difference between the upper and lower portions in the lifting conduit 24 or the coupling conduit 21, and the operation may be temporarily stopped upon sensing such pressure difference.

The present invention further provides an improvement for overcoming such drawback for necessitating temporary shutdown of the system.

Figure 13:
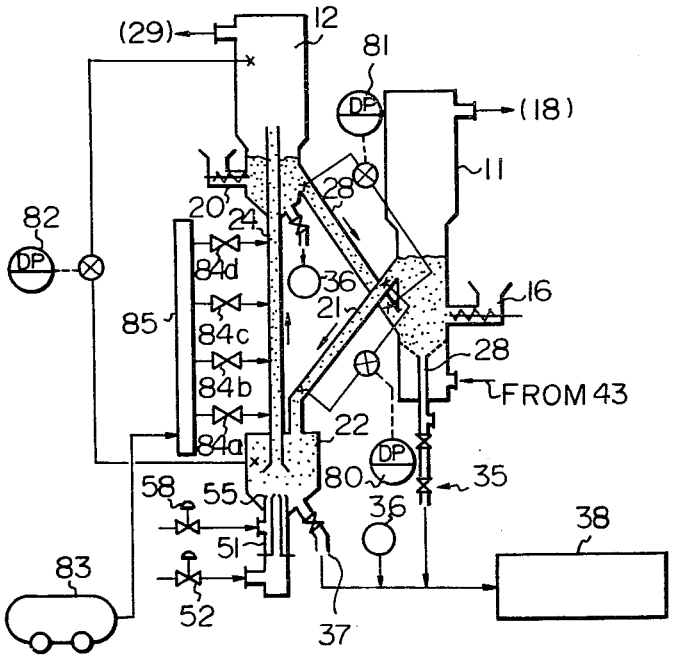
FIG. 13 is a schematic illustration of means for preventing blowing through of unwanted gas and blocking of the sand passage.

Referring now to FIG. 13, means for preventing such temporary shoutdown of the system due to foreign substances is illustrated. In this drawing, the elements bearing the same references as those touched upon in the foregoing are to be considered to be the same in function as those in the other drawings.

The sealing state between the two reactors 11 and 12 is monitored by pressure difference sensors 80 and 81 adapted to sense the pressure difference between the opposite ends of the coupling conduits 21 and 28, respectively. A pressure difference between the free board of the regenerator 12 and the ejecting reservoir is monitored by a gauge 82 to detect in advance the condition of the occurrence of unstable operation or blocking. The flow meter 61 (FIG. 5) may be utilized in lieu of the gauge 82. By sensing the circulation rate of the sand or the pressure difference using the gauge 82 or flow meter 61 or sensors 80 and 81, if a rise in the pressure in the lifting device is sensed, the possibility of blocking in the lifting conduit or gas leaking or blowing through is foreseen. If the cause thereof is judged to be a pressure increase in the lifting portion, the following steps are effected:

a. Regulation of the valve 58 so as to decrease the ring air thereby decreasing the lifting rate of the sand;

b. Regulation of the valve 52 so as to increase the flow rate of the lifting gas and reduce the ratio of the sand relative to the lifting air.

c. Should it be that, even with either or a combination of steps "a" and "b" above, the condition is still not satisfactory, pressurized air and/or vapor is injected into the lifting conduit 24 from a pressure source 83 through a plurality of valves **84*a*, 84*b*, 84*c* and 84*d* disposed adjacent the lifting conduit 24, a header 85 being disposed between the valves 84*a* to 84*d* and the pressure source 83. The valves 84*a* to 84*d*** may be opened sequentially from the lower side or upper side or randomly.

Upon the operation of the steps "a", "b" and "c" above, a foreign substance adjacent the ejecting reservoir 22 is removed by means of the discharging means 37. If the operation returns to stable condition by the steps "a", "b" and "c" above and the pressure difference is gradually reinstated to the normal value, the supply of pressurized fluid from the source 83 is stopped and the respective flow rates of the lifting air and the ring air are reinstated to their set values. By regulating as above, shutdown of the system is prevented.

The present invention has been explained in detail referring to a specific embodiment. However, the present invention is not limited to that explained hereinabove and it may be modified or changed by those skilled in the art within the scope and spirit of the present invention which will be defined in the claims appended hereto.

What is claimed is:

1. An apparatus for effecting pyrolyzation in a two-bed fluidized pyrolysis system, said apparatus comprising:

a pyrolysis reactor of the fluidized bed type with sand as the fluidized medium;

a combustion reactor of the fluidized bed type including a lower portion for receiving sand from said pyrolysis reactor and an upper portion where combustion is effected and into which sand is lifted from said lower portion;

coupling conduit means for coupling an upper part of said pyrolysis reactor with said lower portion of said combustion reactor, and for coupling said upper portion of said combustion reactor with a lower part of said pyrolysis reactor;

means for sensing physical factors concerning the state of fluidization and including:

means for sensing the pressure difference between the free boards of said two reactors;

means for sensing the pressure difference between said upper and lower portions of said combustion reactor; and means for determining the levels of fluidized beds of said two reactors by measuring the pressure difference between the upper and lower portions of the respective said fluidized bed of each said reactor;

control means for regulating the values of said physical factors; and sand lifting means for lifting sand upwardly from said lower portion of said combustion reactor into said upper portion of said combustion reactor and including:

a lifting conduit coupling said lower portion and said upper portion;

nozzle means for injecting pressurized gas into a lower end of said lifting conduit;

a ring gap means surrounding said nozzle through which air is blown around the nozzle;

means for regulating flow rate of gas injected through said nozzle; and regulating means for regulating flow rate of air blown from said ring gap means.

2. An apparatus as claimed in claim 1, further comprising means for sensing the pressure difference between the opposite ends of said coupling conduit means coupling said upper part of said pyrolysis reactor and said lower portion of said combustion reactor.

3. An apparatus as claimed in claim 2, further comprising injecting valve means connected to said nozzle means for injecting pressurized gas into said lifting conduit when either the pressure difference sensed by said means for sensing the pressure difference between said upper and lower portions of said combustion reactor or the pressure difference sensed by said means for sensing the pressure difference between said opposite ends are beyond respective predetermined values thereof.

4. An apparatus as claimed in claim 2, wherein said control means includes a sand feeder for supplying sand into said upper portion of said combustion reactor.

5. An apparatus as claimed in claim 4, wherein said control means is arranged to regulate the amount of sand supplied to the system by controlling said sand feeder and discharging means accompanying said pyrolysis reactor and said combustion reactor for discharging non-combustible constituents contained in the material to be pyrolized.

6. An apparatus as claimed in claim 1, wherein said sensing means further includes means for determining the superficial velocity in said pyrolysis reactor.

7. An apparatus as claimed in claim 1, wherein said apparatus further comprises means for regulating the feed rate of material to be pyrolized to said pyrolysis reactor.

* * * * *